US005356257A

United States Patent [19]

Nijenhuis

[11] Patent Number: 5,356,257

[45] Date of Patent: Oct. 18, 1994

[54] CARRIAGE FOR LIFTING AND MOVING A CONTAINER

[75] Inventor: Derk Nijenhuis, Hoogeveen, Netherlands

[73] Assignee: N.C.H. Hydraulische Systemen B.V., Al Hoogeveen, Netherlands

[21] Appl. No.: 861,970

[22] PCT Filed: Jan. 4, 1991

[86] PCT No.: PCT/NL91/00002

§ 371 Date: Aug. 3, 1992

§ 102(e) Date: Aug. 3, 1992

[87] PCT Pub. No.: WO91/09792

PCT Pub. Date: Jul. 11, 1991

[30] Foreign Application Priority Data

Jan. 5, 1990 [NL] Netherlands ..... 9000030

[51] Int. Cl.[5] ..... B60P 1/02; B60P 3/00; B66F 7/00; B62D 61/12

[52] U.S. Cl. ..... 414/495; 414/459; 414/460; 254/45; 280/43.13; 280/767

[58] Field of Search ..... 414/458, 459, 460, 441, 414/495; 410/35, 66, 67, 82, 83; 280/43.13, 43.17, 43.22, 43.23, 767; 254/45, 89 M

[56] References Cited

U.S. PATENT DOCUMENTS

| | | | |
|---|---|---|---|
| 1,693,700 | 12/1928 | McCall et al. | 254/7 R |
| 2,178,647 | 11/1939 | Raymond et al. | 280/43.13 X |
| 3,096,995 | 7/1962 | Richnow, Jr. | 280/43.23 X |
| 3,414,072 | 12/1968 | Hodges, Jr. et al. | 280/43.23 X |
| 3,541,598 | 11/1970 | Dousset | 254/45 X |
| 3,631,999 | 1/1972 | Walerowski | 280/43.23 X |
| 3,682,423 | 8/1972 | Scarborough | 410/83 |
| 3,749,363 | 7/1973 | Hauser | 254/45 |
| 4,419,034 | 12/1983 | DiMartino | 410/83 |
| 4,611,816 | 9/1986 | Traister et al. | 414/458 X |

FOREIGN PATENT DOCUMENTS

| | | |
|---|---|---|
| 1106691 | 5/1961 | Fed. Rep. of Germany . |
| 1556200 | 7/1970 | Fed. Rep. of Germany . |
| 1056947 | 3/1954 | France . |

*Primary Examiner*—Michael S. Huppert
*Assistant Examiner*—Stephen Gordon
*Attorney, Agent, or Firm*—Bachman & LaPointe

[57] ABSTRACT

For picking up and moving containers with corner castings on platforms, railway wagons or ships, two carriages are locked one to each end face of the container. These carriages have sets of wheels, which are vertically movable therein and allow displacement of the carriages in their longitudinal direction. With the wheels of each set at the same height, the carriages are in the lowest position and can be locked by locks in the corner castings of the container. By moving one wheel of each set of each carriage down, the carriage and, if locked thereto, the container are lifted for displacement. Such wheels can bridge gaps between loading surfaces and differences in height between such surfaces. The carriages may also have wheels with a horizontal axis transverse to the other wheels, to allow movement of the carriages with or without a container transversely to their longitudinal direction.

8 Claims, 4 Drawing Sheets

CARRIAGE FOR LIFTING AND MOVING A CONTAINER

The invention relates to a carriage for picking up and moving containers.

It is often necessary to load and unload large numbers of containers, for example into ships from a quay and out of ships onto a quay, and from a quay onto a road or rail vehicle, or vice versa.

Such vehicles move the containers over desired distances, for example to and from places inland, where the contents of the container have to be unloaded from it and from where the container has to be returned empty or with another load.

The transfer of the containers from a storage place to a ship or vehicle and vice versa is normally carried out by cranes or with forklift trucks travelling along the floor of a storage park.

The so-called sea containers (ISO containers) commonly used at present have a so-called corner casting in each corner, which is a box-shaped casting with a slit-shaped opening in the bottom face and in the two upright external faces. The crane or forklift truck in this case generally has a lifting frame with non-circular locks which can engage in such openings in the top corners of the container and by turning about their axis can be locked therein, in order to ensure that the container can be safely lifted and deposited again in a desired place. For loading and unloading ships and for many other instances where large numbers of containers have to be moved in a storage park and loaded onto and unloaded from vehicles this is an adequate system which justifies the necessary capital investment for it.

Inland in particular, where smaller quantities of containers have to be loaded and unloaded per unit time, there are generally no such facilities, and it is economically unjustified to provide them. It is then necessary to resort to other means, such as ordinary cranes which are also suitable for other purposes, the container being lifted and lowered with slings round it, to lorries with means for removing the containers from them or pulling them onto them with a horizontal movement with movable hooks, cables or drawbars, possibly with a tipping body on the lorry etc.

The object of the invention is to provide a simple system to produce an efficient solution to this in many cases.

To this end a carriage of the type mentioned in the preamble is according to the invention characterized in that it has a frame having therein near one end a gripping means projecting laterally from it for gripping a container, such as a rotary lock with non-circular head, which can engage with a corner casting of a container, and having near said gripping means a bearing structure for a set of two wheels with horizontal transverse axis with a horizontal distance between them in the lengthwise direction of the carriage, on which bearing structure means act in order to move the wheels up and down in opposite directions to each other, and in order to hold them in position as to their height with one wheel higher than the other, all this in such a way that the carriage together with a similar carriage at the other side of a container can grip the latter and can lift it over a short distance by moving one of the wheels of each set downwards so that it can be shifted in the lengthwise direction of the carriage.

It is thus possible to move such carriages to opposite sides of a container, to make the gripping means grip it and thus be locked therewith, to lift the container through height alteration of part of the wheels relative to the frame of those carriages, and to shift the container with the carriages, while the two wheels of a set which can be moved mutually in height direction of the frame can be operated during travelling over transitions between, for example, a loading platform and a loading face of a vehicle, in such a way that the container can be moved smoothly from one plane to the other, even if there are horizontal clearances and height differences between these planes.

Said gripping means preferably engage in the bottom corner castings of the containers, which means that the carriages can be low, simple and light. Since the carriages are mobile in their lengthwise direction, the most feasible design of the carriages is such that they engage on the short end faces of a container in order to move it at right angles to the lengthwise direction, and near each end have such a gripping means and such a bearing structure for a set of wheels. If containers are also to be moved in the lengthwise direction of the containers with such carriages, the carriages can also be equipped with vertically movable wheels which rotate about horizontal axes at right angles to those of the earlier mentioned wheels.

The most preferable is a simple design in which the wheels of each set are mounted so that they can rotate but cannot be shifted in position in a carrier which is fitted in the frame so that it is tiltable about a transverse axis parallel to the wheel axis and lying in a vertical plane between the wheels. It is then possible with a simple control device such as a linear motor to tilt the carrier and fix it in any desired position, with the wheels of a set at the same height, or one higher than the other.

The carriages are preferably provided with their own drive which acts on the above-mentioned wheels.

A method for the use of such carriages is according to the invention characterized in that such a carriage is moved along each of two opposite sides of a container, in that the gripping means thereof are made to grip the container, in that at least one wheel of the carriages in each corner of the container is moved downwards relative to the frame of its carriage in order to lift and carry the container, in that the container with the carriages is moved, and in that at the destination the wheels which had been moved downwards are moved upwards again in order to deposit the container.

The invention will now be explained in greater detail with reference to the appended drawings, showing a preferred embodiment of a carriage according to the invention with illustration of the way in which it cooperates with a sea container to be moved. In said drawings.

Figure 3:
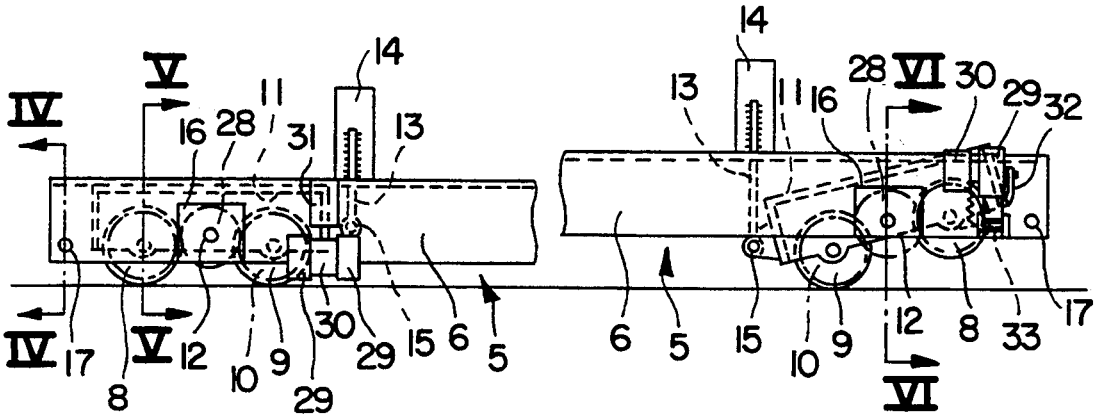
FIG. 3 is a somewhat schematic side view of a carriage according to the invention with the centre part cut away, and in a different position on the left from that on the right.
Figure 7:
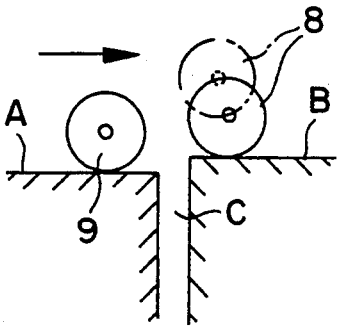
Figure 8:
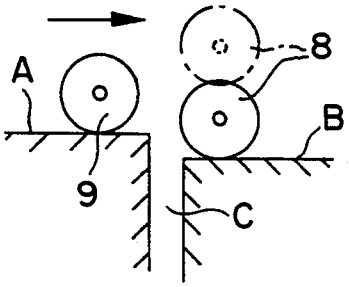
Figure 9:
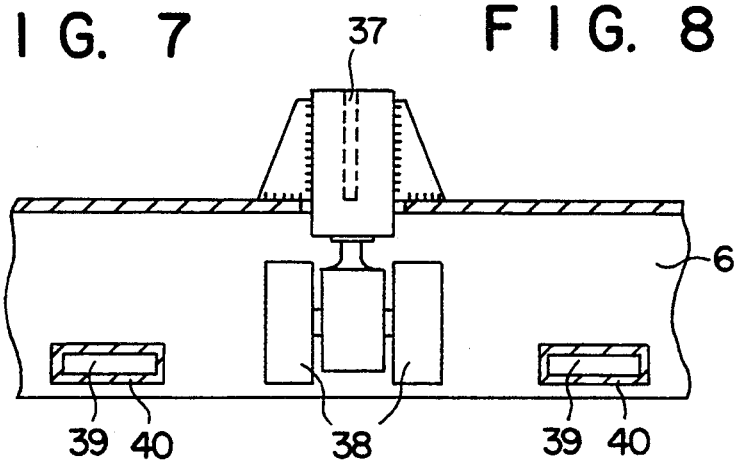

FIGS. 7 and 8 are each schematic side views of a set of wheels of a carriage according to the preceding figures, with adjacent parts of a station platform or quay and of, for example, the loading face of a rail wagon in different positions during use; and FIG. 9 shows a vertical section in a plane parallel to the lengthwise direction of the carriage according to FIG. 3, showing only the centre part thereof.

A loading and/or unloading platform 1 is adjacent to a railway track 2, along which a loading and/or unloading platform 3 runs on the opposite side. The platforms can have reinforced traffic strips 4 in order to ensure that they are well able to accommodate the loads from containers to be moved over them.

Figure 5:
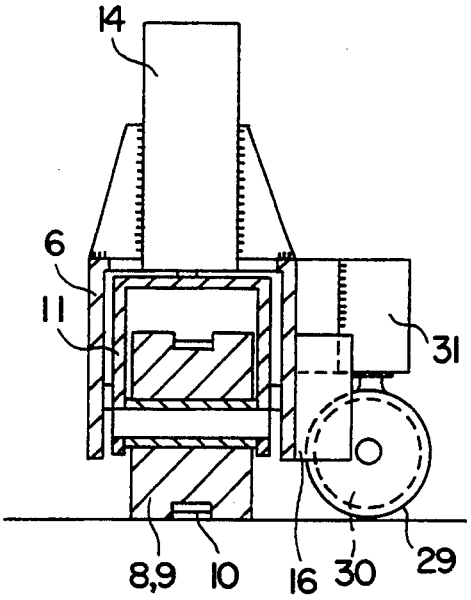
FIG. 5 is a section along the line V—V in FIG. 3, on a larger scale.

Carriages 5 are movable along said platforms 1 and 3. They comprise a hollow horizontal box frame 6, which in the bottom face is fully open, or is open only near the ends, and with openings in the top face, and has a set of wheels 8 and 9 therein at each end. The wheels are fairly broad, so that the carriage can travel without the risk of tilting. Each wheel in fact comprises two narrower wheels one to the side of the other on the same axle with a space between them, in which a gear wheel 10 which is firmly coupled to said wheels is provided (FIG. 5).

The wheels 8 and 9 are mounted rotatably at a horizontal distance from each other in a carrier 11 (FIGS. 3 and 5) which is provided so that it can swivel on a shaft 12 (FIGS. 3 and 6) in the frame 6 of the carriage 5. The piston rod 13 of a hydraulic cylinder 14 engages hingedly at 15 on each carrier 11, preferably on the inner side of the carriage as seen in the lengthwise direction thereof, permitting some horizontal displacement, necessary because said cylinder 14 is fixed to the frame 6, and said hinge point must be able to move a little horizontally when the carrier tilts.

A rotary lock 17 with non-circular head 18 is situated at each end of the carriage 5. It can be seen from FIG. 4 that the shaft 19 of said lock is accommodated in a sleeve 20 which is welded locally in the box frame 6, has a widened part 24 at the side where the lock head 18 is situated, and projects beyond said frame at the other side away from where the lock head 18 lies. Said sleeve 20 has an axial slit 21 in its top edge, at the end closest to the frame 6 passing into a peripheral slit 22. The shaft 19 of the lock has a radial recess, in which a rod 23 can be fixed or can be inserted detachably therein.

The shaft 12 is rotatably mounted in the tubular frame 6 (FIG. 6), and a hydraulic motor 16, which can drive said shaft 12 in a rotary manner, is fitted against one external side of said frame. A pinion 28 (FIG. 6) is keyed onto the shaft 12 near the central longitudinal plane of the frame 6, and said pinion meshes with the pinion parts 10 of the appropriate wheels 8 and 9 in the same carrier 11.

Figure 1:
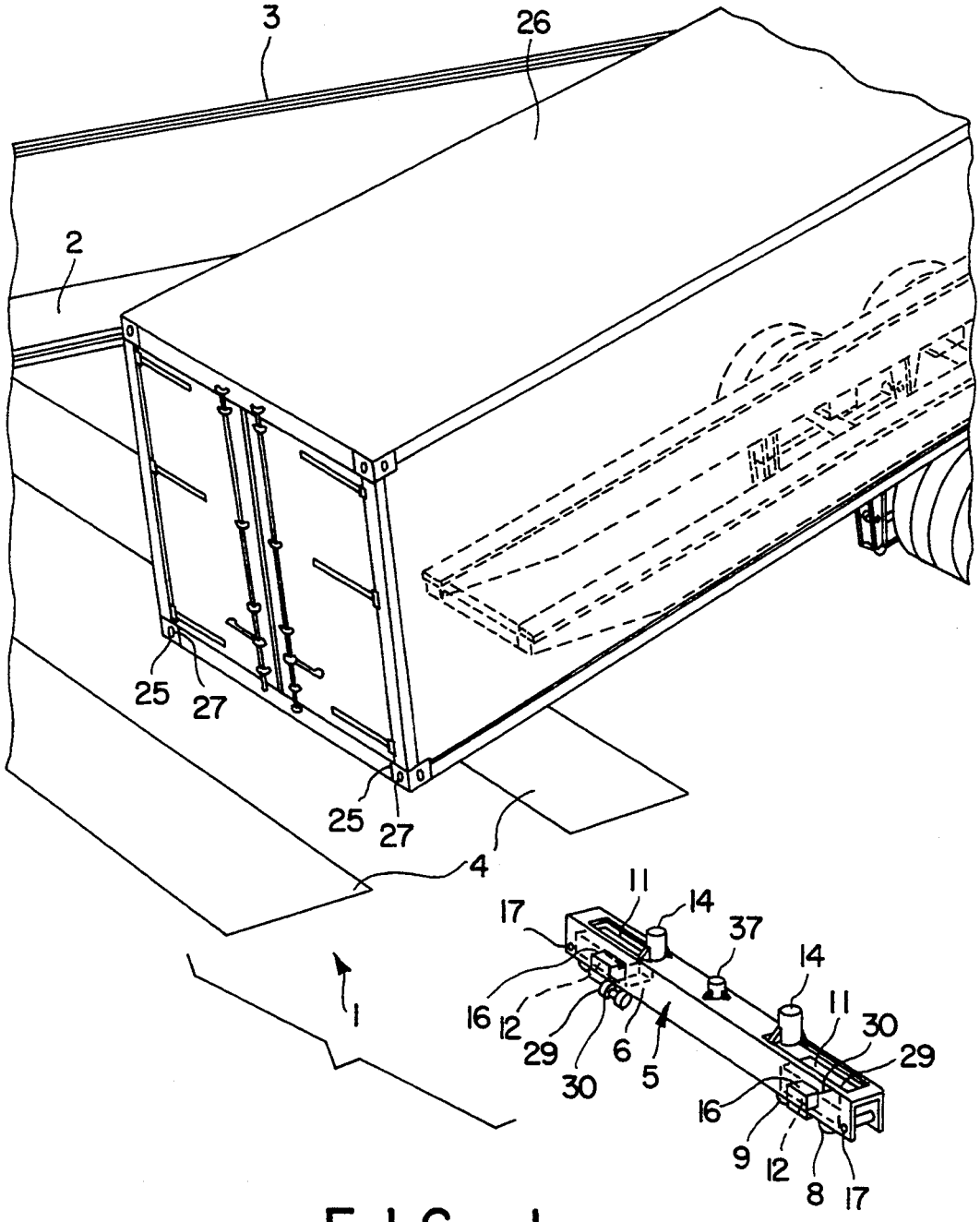
FIG. 1 is a perspective view of a loading and/or unloading platform with carriage according to the invention, and with a sea container which is just being deposited thereon from a lorry.
Figure 2:
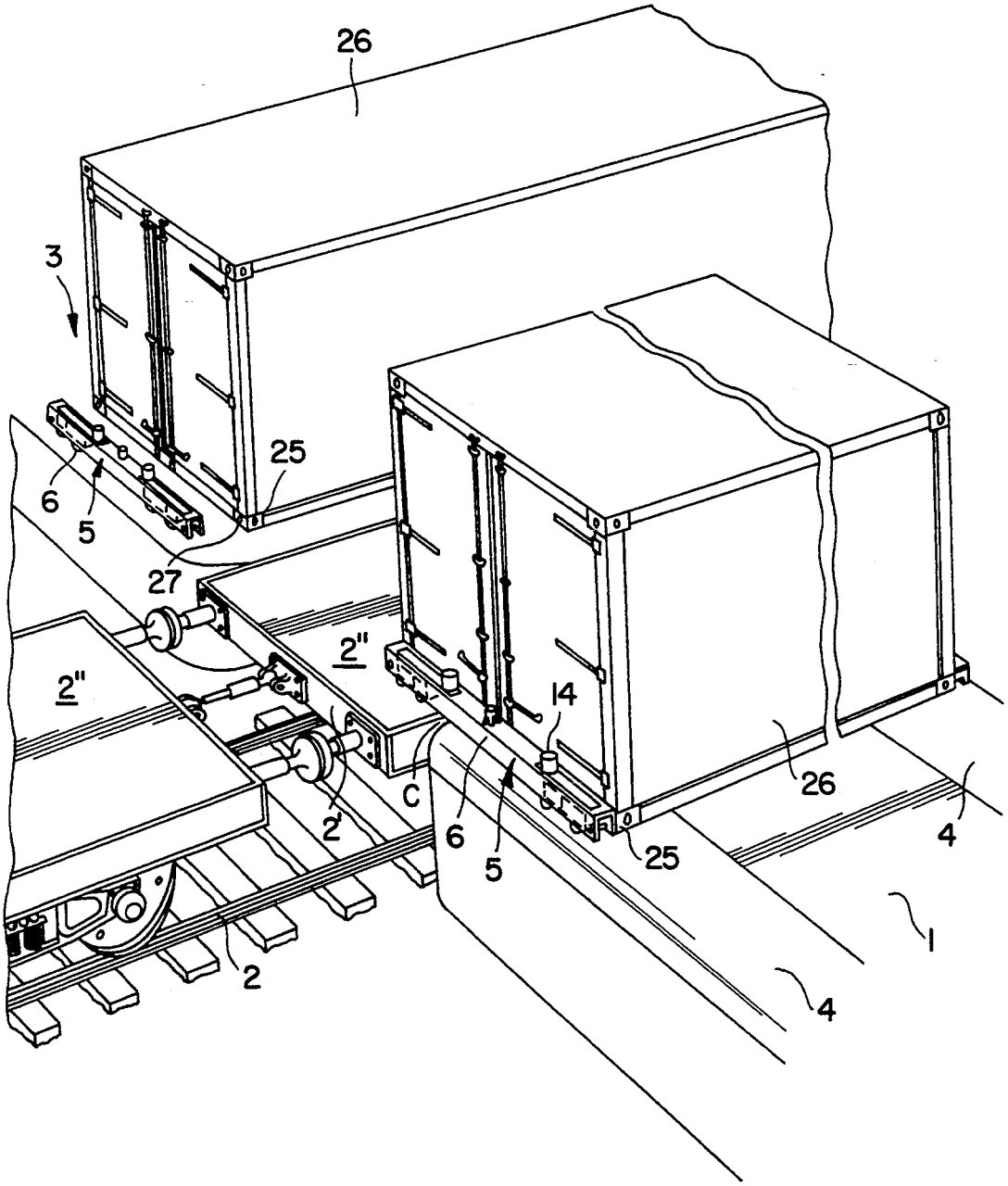
FIG. 2 is the same type of perspective view of a part of said platform with rail wagons and platform at the other side, with containers and carriages.
Figure 4:
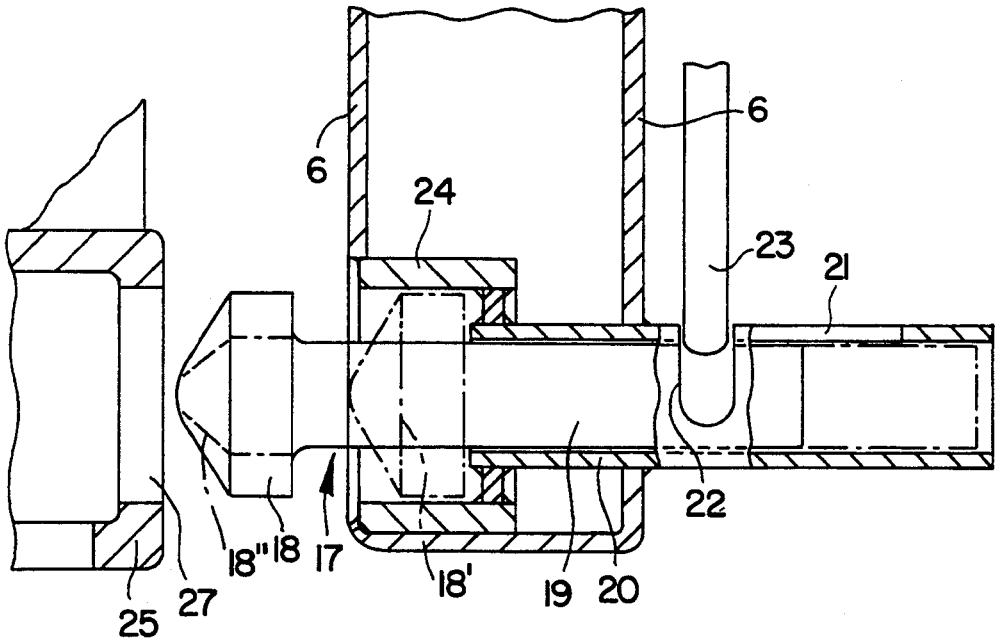
FIG. 4 is a partial section along the line IV—IV in FIG. 3, on a considerably larger scale.

When the carrier 11 is in the horizontal position, as shown on the left in FIG. 3, the wheels 8 and 9 are at the same level, and the frame 6 is in the lowest position. The locks 17 then lie precisely at the level of a slit 27 of a bottom so-called corner casting of a container 26, which is the standard design for sea containers (FIGS. 1, 2 and 4). Tilting the carrier 11 by extending or shortening cylinder 14 causes one of the wheels 8, 9 of the set of wheels fitted in said carrier 11 to lie lower, which in the case of a supporting face at the same height on which the carriage 5 is standing means that the frame 6 will move to a higher level.

This device operates as follows: By means of a rod 23, each lock is moved to the right out of the position shown by solid lines in FIG. 4 until the non-circular head 18 lies retracted in a widened part 24 of the sleeve 20, as shown by dotted lines in FIG. 4 (position 18'). The carriage 5 is now shifted from the position shown in FIG. 1 to just along the short end face of the sea container 26 deposited by a vehicle (FIG. 1). If in the meantime the wheels 8 and 9 of each set are placed at the same height, as shown on the left in FIG. 3, each of the lock heads 18 is now situated directly in front of a slit 27 in a corner casting 25, each in a corner at the bottom of the container. Sliding the locks to the left in FIG. 4 by means of the rod(s) (23) causes the lock heads 18 to project from the frame 6, and they each pass through a slit 27 into such a corner casting 25, following which they are turned by moving the rod 23 through the peripheral slit 22. The heads 18 thus lock the carriage 5 with the container. The turned lock head 18 is indicated in side view by dashed and dotted lines 18''. FIG. 4 shows the frame 6 at some horizontal distance from such a corner casting 25, but with such locking the carriage 5 has been brought directly against and alongside the container.

After two carriages 5 have been locked in this way with the container, each one with one narrow end of the container, and each at both ends thereof, the hydraulic cylinders 14 are shortened extended and are kept locked in the shortened or extended position. During this shortening the outer wheels 8 move downwards relatively, and during extension the inner wheels 9 move downwards. In both cases the frame 6 of their carriage is thereby lifted, and with it the container 26 locked in the manner described with the two carriages at each end of the container. Depending on the direction in which the container has to be shifted, it is preferable for one wheel 8 to be raised and at the other side to raise just the wheel 9, so that in the direction of travel the front wheels of each set reach the raised position. By energizing the hydraulic motors 16, and thus by driving the wheels 8 and 9, the container can in this way be moved to the side, for example from platform 1 to loading face 2'' of a rail wagon 2' on the rails 2, or from such a rail wagon to such a platform, for example to platform 3 (FIGS. 1 and 2) at the other side of the railway track 2. By subsequently extending or shortening the cylinders 14 respectively, the wheels 8, 9 of each set are brought to the same height again (on the left in FIG. 3), the frame 6 of the carriages lowers with the container and deposits it on wagon or platform, after which by means of a rod 23 each lock 17 is then turned until the head 18 is in the position shown by solid lines in FIG. 4, and each lock is moved back (to the right in FIG. 4), so that the lock head 18 moves out of the comer casting 25 in question, and the carriage 5 thus is detached from the container and can be moved away. If desired, the carriages can also be kept connected to the container if it still has to be moved with them later on, both on a platform or on a rail wagon, and in the latter case this can be taken advantage of to use the carriages elsewhere in order to move the container from the rail wagon.

Exactly the same operations can be carried out when moving containers onto and from ships from or onto a quay.

FIGS. 7 and 8 show how, when a container is being moved to the right, the wheels 8 and 9 can be manipulated. When the container is lifted, the first oncoming wheel 8 lies higher than the corresponding wheel 9. If the move now has to be from a loading face A onto a loading face B, then the two carriages with the container are moved until wheel 8 of the righthand set lies above loading face B, and the gap C between said loading faces has thus been passed by it. The carriers 11 of these wheels are now tilted until wheel 8 rests on loading face B, thus has moved from the position shown by dotted lines to the position shown by solid lines in FIGS. 7 and 8. The carriers 11 are now tilted a little further, until the wheels 9 are lifted clear of loading face A, and the container can now be moved with the carriages further onto loading face B. When a container is being moved from a platform onto a rail wagon the loading face 2" of the latter in the unloaded state normally lies slightly higher than the platform, while in the loaded state the springs thereof compress slightly, so that said loading face is eventually at approximately the same height as, or can be slightly lower than, the platform.

When the other set of wheels of the same carriage 5 now reaches this transition, the same action is taken, but this time the wheel 9, which is in the raised position, is moved downwards onto loading face B, until wheel 8 is raised from loading face A.

Since the wheels 8, 9 of each set thereby pass the position in which they are at the same height, the container can touch the higher of the two adjacent loading faces with its bottom edge. This is no problem, since the wheels are preferably tilted when the container with carriages thereon is at a standstill, so that platform, loading face or container are not damaged. This can, however, be prevented if desired by moving only one wheel at a time downwards ( such as 8 in FIGS. 7 and 8 ) until it has transferred a large part of the weight of the container onto loading face B, and then moving the same wheel (8 in FIGS. 7 and 8) at the other side downwards. The container then rests temporarily on three points. This touching of a loading face by the container could also be prevented by fitting the carriers 11 so that they are vertically movable in the carriage, but this is unnecessarily complicated in most cases.

In order both to join up containers which can be picked up well laterally and also to move them in their lengthwise direction, the frame 6 is provided near each end with one or two transverse wheels 29 (FIGS. 1, 5 and 6), which are preferably drivable by a hydraulic motor 30, and which are movable up and down relative to the frame 6 between a raised non-operating position and a lower position projecting below the frame 6 and the wheels 8 and 9. Many embodiments are possible for this, and a different embodiment of it is shown on the left in FIG. 3 from that shown on the right in FIG. 3. The embodiment on the left in FIG. 3 is shown in FIG. 5 in longitudinal view along the frame 6, since it can be seen directly from the plane of section V—V in FIG. 3 to the right, while the embodiment on the right in FIG. 3 can be seen from the plane of section VI—VI, and is thus shown in FIG. 6.

In the embodiment of FIG. 5 provision is made between the two wheels 29 for a hydraulic motor 30, the housing of which is non-rotatably connected to the piston rod of a hydraulic cylinder 13 which is fixed to the frame 6. The cylinder 31 can press the wheels 29 down so far that the frame 6 remains in the raised position, as shown on the right in FIG. 3, even when the wheels 8 and 9 are at the same height. If two of such structures are provided on each carriage 5, a container with the four structures of this type, two on each side, can then be moved, with wheels 29 pressed down and locked in their vertical position, by operating the hydraulic motors 30.

Figure 6:
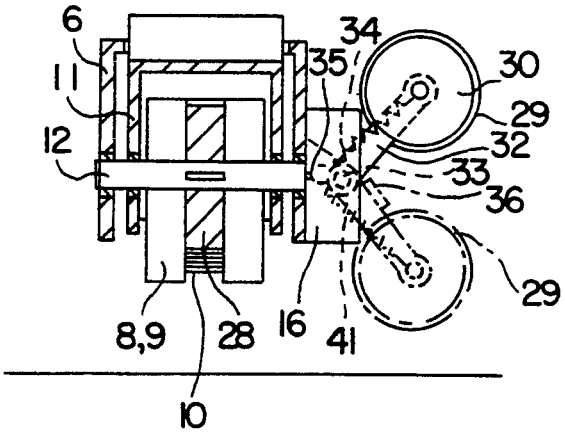
FIG. 6 is a section along the line VI—VI in FIG. 3, on a larger scale.

The embodiment of this structure shown in FIG. 6 can also have a hydraulic cylinder for pressing down the wheels 29, but this can also be omitted here and is not shown. The wheel 29 here is situated on an arm 32, for example comprising a fork or two parallel arms, while the wheel 29 is accommodated between the teeth of the fork or between said two arms, and the hydraulic motor 30 is fitted on the outside against one of the arms or teeth of the fork. The arm 32 is fitted so that it pivots at 33 about a pivot pin in a bracket against the side wall of the frame 6. A tension spring 34 connects the axle of the wheel 29 to a fixed point 35 on frame 6, which point 35 lies at the level of the pivot pin 33. A stop 41 on the bracket of pivot 33 limits the rotation of arm 32 downwards, and a lock 36, which can be operated manually, confines the arm 32 in the bottom position, so that the arm 32 in that position can absorb great upward forces without moving upwards. If desired, the lock 36 can swing away sideways (in the lengthwise direction of the carriage) against the force of a light spring when the arm 32 moves downwards, for example through a slanting face on arm or lock which on contact between these parts downwards makes the lock give way until the arm 32 can pass the lock downwards. The spring 34 normally holds the arm 32 in the highest position against a stop which is not shown. If a projection (not shown) on arm 32 of the wheel 29 itself is pressed downwards, for example with the foot, arm 32 passes the horizontal position in which spring 34 is tensioned to the maximum, so that on further downward movement it pulls the arm 32 to the lowest position. If the wheels 8 and 9 are in such a position that the wheel 29 cannot reach the lowest position, then it hits, for example, the platform or the like such as 1 or 3. In order to make the carriage 5 rest on the wheels 29, the hydraulic cylinders 14 are now operated in such a way that one of the wheels 8 or 9 of each set lifts the frame 6 sufficiently to take the wheels 29 into the lowest position and to lock them with lock 36. By now reducing the height difference between the wheels 8 and 9 of each set, the wheel 8 or 9 thereof bearing the carriage 5 is raised in such a way that the carriage 5 rests on the wheels 29. If one wishes to reach this position even if the carriage 5 is not linked to a container, it is advisable to fit one or more further wheels inside the frame 6, of which the axle direction corresponds to that of the wheels 29, and which can be moved up and down, for example by means of a hydraulic cylinder, in order to ensure that the carriage does not tilt about its longitudinal axis. This is shown in detail in FIG. 9, which shows the central part—omitted in FIG. 3—of the frame 6 of a carriage in cross-section in a vertical plane parallel to the lengthwise direction of the carriage. A hydraulic cylinder 37 is fitted in upstanding position in the centre of the frame 6, and its piston rod carries two freely rotatable wheels 38. These lie in the centre between the upright side walls of the frame 6 or, if the width between said side walls permits, as far as possible outside that towards the side wall which comes to rest against the container to be picked up. If the wheels 29 of FIG. 5 or 6 are now to be used to bear the carriage, with or without container, cylinder 37 is used to press said wheels 38 down to the same extent as the wheels 29, so that the carriage rests on the base at three points which are not in line with each other, namely through the wheels 29 and 38, and thus cannot tilt at right angles to its lengthwise direction, even in the absence of a container.

The wheels 29 with their supporting and operating structures as shown in FIGS. 5 and 6 could be omitted entirely if wheels 38 with cylinders 37 could be fitted on either side at a considerable distance from the centre between the side walls of the frame 6, but there is generally not enough space for this in the frame, due to the presence of the tiltable carriers 11 and locks 17 in those zones away from the centre of the frame 6.

FIG. 9 also shows how rectangular openings 39 can be provided on either side of the centre near the bottom end of one of or both side walls of the frame 6, here joining rectangular sleeves 40 which are welded between said side walls and in which the teeth of a forklift truck can engage in order to move the whole carriage with it. If desired, such sleeves 40 can also be welded against the bottom of said side walls instead of slightly above the bottom edge.

The carriages, with or without container between two of said carriages, can now be moved at right angles to the lengthwise direction of the carriages and in the lengthwise direction of the container by driving the wheels 29 by means of their hydraulic motors 30. If desired, the wheels 38 also have a hydraulic motor drive.

Means (not shown) for energizing the hydraulic motors, such as a pump with storage and buffer tank for hydraulic medium, a drive motor for this, lines, operating switches etc., can be fitted in or on the frame 6 of each carriage. Said drive motor can be an electric motor, powered by a battery on the carriage, which battery can have an electrical connection for charging in a charging station, for example at night or at other times when the carriage is not being used.

I claim:

1. A carriage for lifting and moving a container comprising:

an elongated hollow frame extending along a longitudinal axis;

first and second gripping means mounted on said elongated hollow frame and spaced from each other along said longitudinal axis, each of said first and second gripping means having movable engagement means for selectively engaging a container;

first and second carrier means spaced from each other along said longitudinal axis each of said first and second carrier means being pivotably mounted on said elongated hollow frame about an axis transverse to said longitudinal axis;

at least one bearing means mounted on each of said first and second carrier means and pivotable therewith about said transverse axis; and first and second motor means connected to said first and second carrier means respectively for pivoting said first and second carrier means on said bearing means for lifting said carriage.

2. A carriage according to claim 1 wherein said at least one bearing means includes a pair of rotatable wheels.

3. A carriage according to claim 1 including means for positioning said engagement means between a retracted position and a container engaging position.

4. A carriage according to claim 3 wherein said engagement means is contained within said elongated hollow frame when in said retracted position.

5. A carriage according to claim 3 wherein said engagement means comprises a rotary lock having a non-circular head.

6. A carriage according to claim 5 wherein the means for positioning said engagement means comprises rod means for rotating the non-circular head about an axis along which the engagement means is moved by said means for positioning between the retracted position and the container engaging position.

7. A carriage according to claim 2 further including at least two further wheels rotatably mounted upon an axis perpendicular to said transverse axis, and further includes means for moving said further wheels up and down relative to the hollow frame so as to lift said hollow frame vertically.

8. A carriage for lifting and moving a container comprising:

an elongated hollow frame extending along a longitudinal axis;

first and second gripping means mounted on said elongated hollow frame and spaced from each other along said longitudinal axis, each of said first and second gripping means having movable engagement means for selectively engaging a container;

first and second support means, each of said first and second support means having a first portion pivotably connected to said elongated hollow frame about a first axis transverse to said longitudinal axis, a second portion spaced from said first portion along said longitudinal axis and a third portion intermediate said first and second portions;

bearing means mounted on each of said support means at said third portion and pivotable about a second axis transverse to said longitudinal axis;

motor means connected to each said second portion of said support means for pivoting each of said support means about said second transverse axis for lifting said first portion of said support means and correspondingly said elongated hollow frame.

* * * * *